United States Patent [19]

Maltais

[11] 4,358,036

[45] Nov. 9, 1982

[54] BELT CLIP

[76] Inventor: William F. Maltais, 124 Charles St., New Britain, Conn. 06051

[21] Appl. No.: 248,265

[22] Filed: Mar. 27, 1981

[51] Int. Cl.[3] ..... A45F 5/02

[52] U.S. Cl. ..... 224/252; 224/255; 224/163

[58] Field of Search ..... 224/163, 229, 252, 255, 224/268, 271, 904

[56] References Cited

U.S. PATENT DOCUMENTS

| | | | |
|---|---|---|---|
| 1,609,347 | 12/1926 | Dee | 224/252 X |
| 2,836,351 | 5/1958 | Epstein | 224/163X |
| 3,357,615 | 12/1967 | Hill | 224/255 |
| 3,929,266 | 12/1975 | Kim | 224/255 |
| 3,970,227 | 7/1976 | Hardy | 224/255 |
| 4,214,688 | 7/1980 | Griffin, Jr. | 224/252 X |

*Primary Examiner*—Steven M. Pollard

[57] ABSTRACT

A belt clip formed by a flat leaf spring, bent into an open, elongated loop, having an upper bend, with downwardly front and rear legs, and a bent hook at a lower end of the rear leg, a secret pocket on the rear leg, a single rivet, through the front leg, pivotally supporting any object from the clip, and a latch arm, for locking the hook from flexing away from under a belt extending through the loop.

1 Claim, 14 Drawing Figures

FIG.1
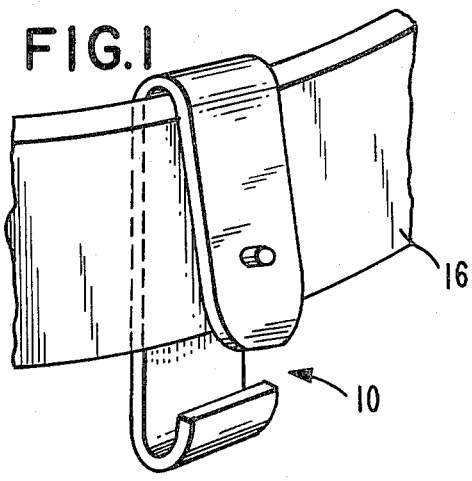
FIG.2
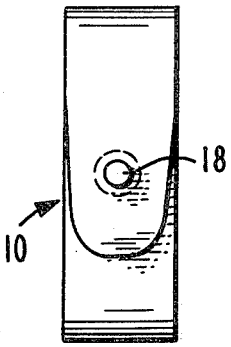
FIG.3
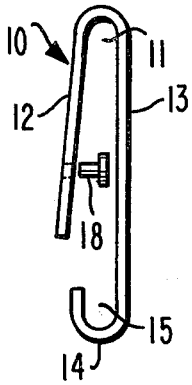
FIG.4
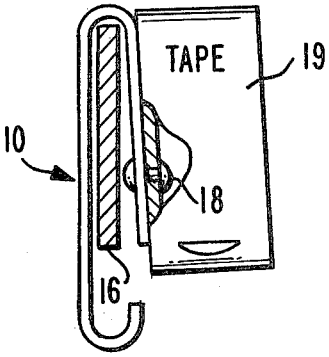
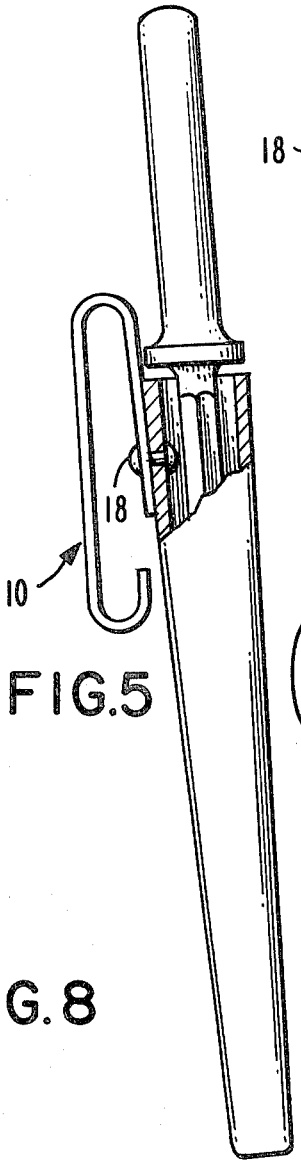
FIG.5
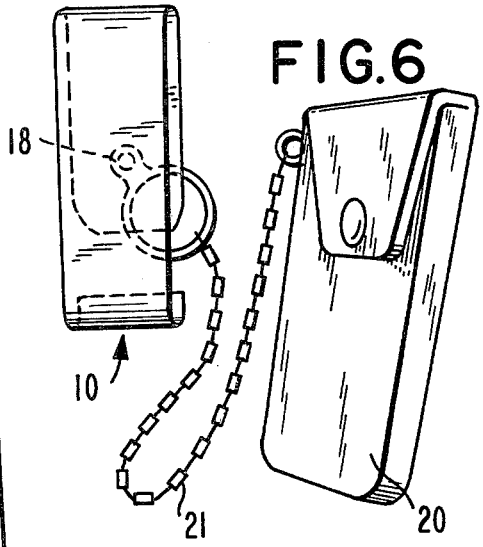
FIG.6
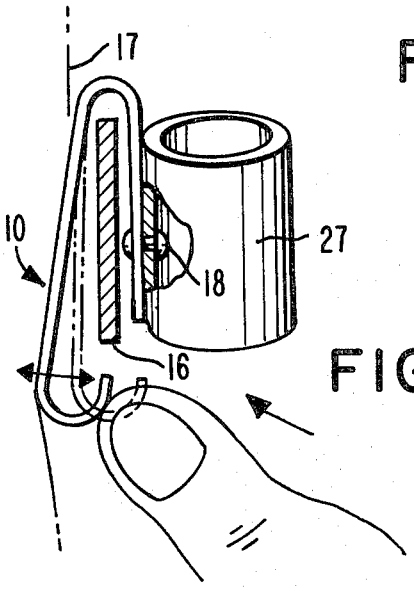
FIG.8
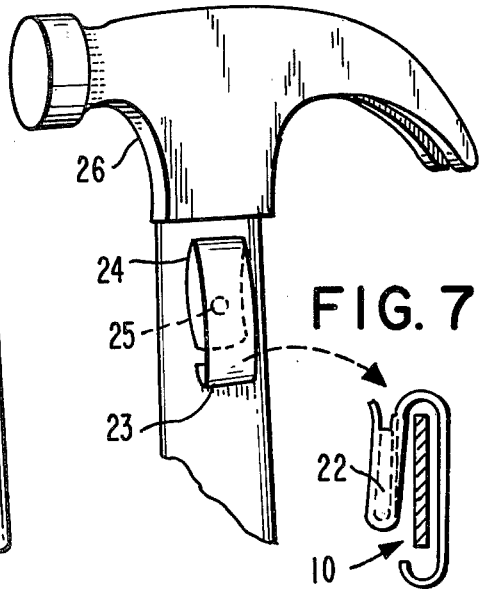
FIG.7

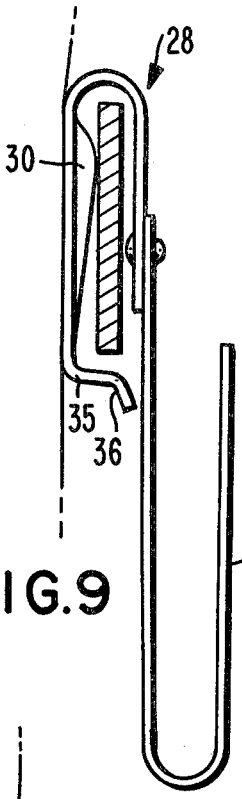
FIG.9
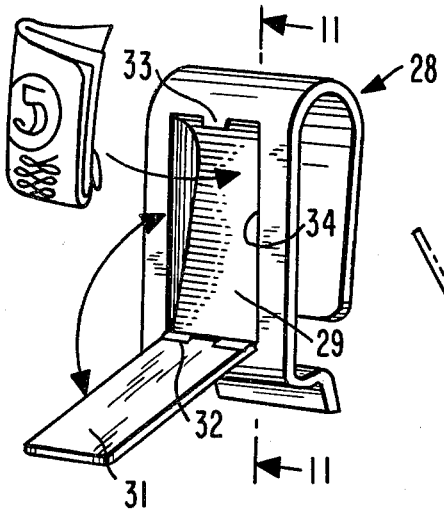
FIG.10
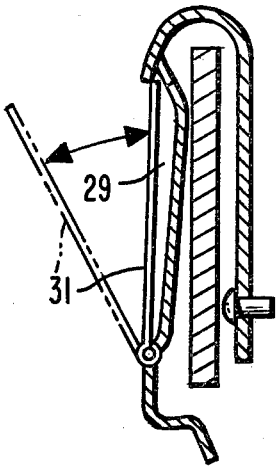
FIG.11
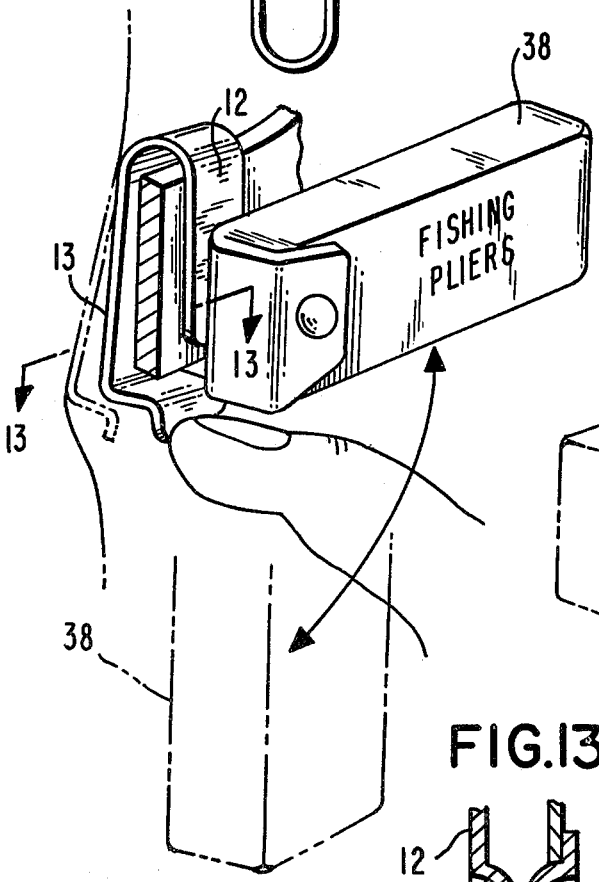
FIG.12
FIG.14
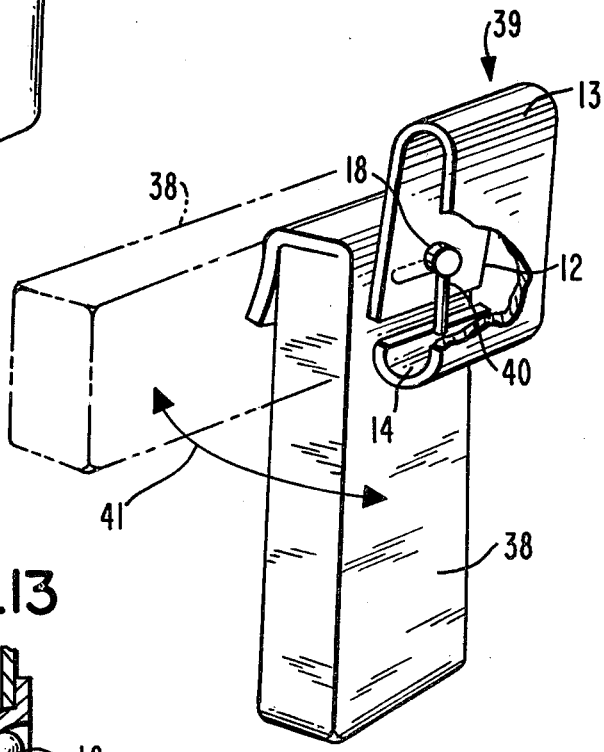
FIG.13
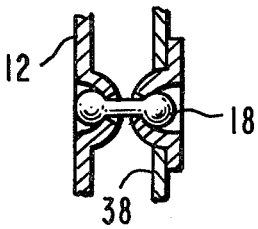

BELT CLIP

This invention relates generally to clips that are attachable to garment belts, for supporting objects therefrom.

It is well known, that numerous kinds of belt clips have been designed in the past, whose sole purpose is that objects may thus be carried by a person in a comfortable and unobtrusive manner.

It is a principal object of the present invention to provide a belt clip, which, in addition to the above-indicated purpose, also includes the feature of being quickly and easily installed on a belt, or removed therefrom when so wished, but which is securely retained upon the belt, by the pressure thereagainst of a belt wearer's body, so that it cannot be accidentally lost, the body pressure normally urging the clip into a locked or closed position.

Another object is to provide a belt clip, which, accordingly, is ideal for supporting tools, a key ring, a wallet or other valuable objects, from a belt.

Yet another object is to provide a belt clip, which, in another design thereof, includes a secret pocket for hiding small valuable items therein, such as a folded-over paper money bill, a ring or a single key.

Yet a further object is to provide a belt clip, which, in yet another design thereof, includes a safety latch, so as to prevent accidental opening thereof, if unintentional pressure is applied thereagainst, which otherwise could open the clip.

Other objects of the present invention are to provide a belt clip, which is simple in design, inexpensive to manufacture, rugged in construction, easy to use and efficient in operation.

These, and other objects, will be readily evident, upon a study of the following specification, and the accompanying drawing, wherein:

FIG. 1 is a perspective view of one design of the invention;

FIG. 2 is a front elevation view thereof;

FIG. 3 is a side view thereof, showing a rivet in position for assembly therewith;

FIG. 4 is a side view thereof, shown with a steel measuring tape instrument riveted thereto;

FIG. 5 is a similar view, showing a hunting knife scabbard riveted thereto;

FIG. 6 is a rear perspective view of the belt clip, showing a chained wallet attached on the rivet;

FIG. 7 is a side view of a hammer or other tool, with a clip attached thereto, which is receivable in another design of the belt clip;

FIG. 8 is a side view of still another design of the belt clip, having a socket riveted thereto, for holding various tools or the like; the belt clip being shown from the belt;

FIG. 9 is a side view of another design of the belt clip, which includes a secret pocket on the rear side thereof, for holding either a folded-over paper money, a key or any other small item, such as a finger ring or the like, and the clip having a hat seat riveted thereto;

FIG. 10 is a rear perspective view thereof, shown with the secret pocket opened;

FIG. 11 is a cross-sectional view, on line 11—11 of FIG. 10, shown with the secret pocket closed;

FIG. 12 shows the belt clip with a fishing pliers case riveted thereto, the case being pivoted out of the way, so as to allow access for a finger to push the clip bottom tab rearwardly;

FIG. 13 is an enlarged cross-sectional view, on line 13—13 of FIG. 12, and FIG. 14 is a rear perspective view of the design shown in FIG. 13, and showing it including a lock for the tab, when the pliers case hangs vertically.

Referring now to the drawings in greater detail, and more particularly to FIGS. 1 through 8 thereof, at this time, the reference numeral 10 represents a belt clip, according to the present invention, wherein the same is made from a flat leaf spring material, and is bent up into a generally open, loop-shaped configuration, as shown in FIG. 3, and which includes an upwardly deep loop 11, formed by downwardly, slightly diverging legs 12 and 13, and a small rounded hook 14, on a lower end of the leg 13, that has a throat 15, of approximately the same width thereacross as the upper end of the loop 11.

In use, the loop 11 is fitted around a belt 16, which thus extends through the clip. The hook 14 is underneath the belt and serves to prevent the clip from being accidentally dislodged therefrom, by any upward force against the clip. To remove the clip intentionally, the hook is pushed against the body 17, around which the belt extends. Thus, the hook is disaligned with an underside of the belt, as shown in FIG. 8, so that the clip may now be lifted upwardly, off the belt. Accordingly, in this design, the outwardly pressure of the body 17 is utilized, to normally retain the hook under the belt, as a safety securement means.

As shown, a rivet 18, on the leg 12 of the clip, provides means for securement thereto of either a measuring tape instrument 19 (shown in FIG. 4), a hunting knife scabbard (shown in FIG. 5), a wallet 20 on a chain 21 (shown in FIG. 6) or the like. FIG. 7 shows a pocket 22, formed on the clip, for receiving a tongue 23 of a clip 24, permanently fastened, by means of a nail 25 or the like, to a side of a hammer 26, or any other tool or object.

In FIG. 8, a socket 27 is secured, by the rivet 18, to the clip; the socket being adaptable for holding all kinds of tools or implements.

In FIGS. 9, 10 and 11, another design of the belt clip 28 is shown, having a secret pocket 29 on the rear thereof, where is is not visible to other persons, and is formed by a bulge 30, bent into the rear leg 12 of the clip. A rearwardly pivotable door 31, on a hinge 32, closes the access to the pocket, and comprises a flexible leaf spring, whose upper edge snap-fits under a tab 33, along an upper edge of an entry doorway 34, closable by the door.

It is to be noted that, in this design, the above-described hook 14 is changed to a horizontal wall 35, at a lower end of the rear leg 12, which is close to a lower edge of the belt, so as to limit more the vertical shifting of the belt within the clip. A downward tab 36, on an end of the wall 35, serves for being depressed by a finger, as shown in FIG. 12.

FIG. 9 shows a deep hook 37 riveted to the clip, whereas, in FIG. 12, a case 38, containing fishing pliers, is riveted thereto. As indicated in FIG. 8, the case, being held by the single rivet 18, similarly to the hook of FIG. 7, is sidewardly pivotable, in order to provide access to the tab 36. FIG. 13 shows another design of the rivet 18.

In FIG. 14, a belt clip 39 is generally similar to the belt clip 10, but includes a latch arm 40, for preventing the hook 14 from being accidentally moved, and the clip thus disengaged from the belt. The arm is affixed on a rivet 18, extending through a hole in the leg 13, and which is affixed to a case 38, or other object carried by the clip, and which is pivotable, as shown by arrow 41, in order to unlatch or latch the hook.

While various changes may be made in the detail construction, it is understood that such changes will be within the spirit and scope of the present invention, as is defined by the appended claims.

What is claimed as new is:

1. A belt clip, comprising, in combination, a flat leaf spring bent into a generally elongated open loop, including an inverted U-shaped bend having front and rear downward legs extending therefrom, and a hook formed on a lower end of said rear leg, and a single rivet through said front leg pivotally holding a carried object on said clip; a forwardly bulge in said rear leg forming a hidden pocket on a rear side thereof, a rearwardly pivotable flat door on said rear leg for closing and opening said pocket; and a latching means for said hook comprising a latch arm affixed on a rear end of said rivet, said latch arm being pivotable, so as selectively to close a gap between a lower end of said front leg and said hook.

* * * * *